United States Patent [19]

Mabery

[11] 4,161,873

[45] Jul. 24, 1979

[54] INTERNAL AND EXTERNAL EXTRUDED NIPPLES OR NOZZLES IN PIPE HEADERS OR BOILER DRUMS

[75] Inventor: Thomas L. Mabery, Chattanooga, Tenn.

[73] Assignee: Combustion Engineering, Inc., Windsor, Conn.

[21] Appl. No.: 872,534

[22] Filed: Jan. 26, 1978

[51] Int. Cl.[2] ..... B21D 28/28

[52] U.S. Cl. ..... 72/324; 29/157 C; 29/157.4

[58] Field of Search ..... 72/324, 335; 29/157 B, 29/157 C, 157.4; 10/86 F

[56] References Cited

U.S. PATENT DOCUMENTS

| | | | |
|---|---|---|---|
| 1,243,005 | 10/1917 | Taylor | 72/324 |
| 2,058,064 | 10/1936 | Culbertson | 29/157.4 |
| 2,157,354 | 5/1939 | Sherman | 10/86 F |
| 2,383,584 | 8/1945 | Beishline et al. | 72/335 |
| 2,632,511 | 3/1953 | Hamilton | 164/108 |
| 2,859,870 | 11/1958 | Hitz | 29/157.4 |
| 3,141,358 | 7/1964 | Burke, Jr. et al. | 29/157 C |
| 3,415,101 | 12/1968 | Reincke | 72/325 |

*Primary Examiner*—Michael J. Keenan
*Attorney, Agent, or Firm*—Robert L. Olson

[57] ABSTRACT

Nipples are extruded on metal parts around holes therethrough by providing an initial hole having a wide portion and a narrower portion, the wide portion having the diameter desired in the finished hole. A tapered mandrel is forced through the initial hole, extruding a nipple and resulting in a hole of the desired diameter.

10 Claims, 2 Drawing Figures

INTERNAL AND EXTERNAL EXTRUDED NIPPLES OR NOZZLES IN PIPE HEADERS OR BOILER DRUMS

BACKGROUND OF THE INVENTION

The present invention relates to the manufacture of metal parts, such as headers and steam drums, to which tubes are to be attached. More particularly, it relates to a method of providing nipples for the attachment of tubes to relatively thick parts.

In the manufacture of steam drums and headers, tubes must be attached around holes in the header or drum. Since welding of a tube directly to a drum or header results in the requirement that a time-consuming heat treatment be provided, it is preferable in many cases to attach the tubes to nipples formed around the hole in the part to which the tube is to be attached. One method of providing the nipple is to drill a hole through the part and then force a mandrel of slightly greater diameter than the initial hole through the hole, the material forced through the hole by the mandrel thereby forming a nipple on the surface of the part. While this approach is quite practical for thin parts, the probability that the part will tear increases with increasing part thickness. Accordingly, an improved method is needed for dealing with relatively thick parts.

SUMMARY OF THE INVENTION

The present invention is an improved method for extruding a nipple on the surface of a metal part. The nipple is to be formed on one surface of the metal part around a hole that extends from that surface through to the other surface of the part. According to the method of the present invention, a hole is first formed in the part, the hole having the desired diameter along a portion that extends part of the way into the hole from the surface opposite that on which the nipple is to be formed. The hole has a second portion with a small diameter in a portion that extends part of the way through the hole from the surface on which the nipple is to be formed. A mandrel having a diameter at its widest point equal to the desired diameter is then forced through the hole in the direction of the surface on which the nipple is to be formed, and a nipple is thereby extruded on the surface.

According to further refinements of the invention, the hole is tapered from its desired-diameter portion to its smaller-diameter portion, the mandrel is tapered at its leading end at least to the diameter of the smaller-diameter portion of the hole, and heat is applied around the hole before the mandrel is forced through the hole.

BRIEF DESCRIPTION OF THE DRAWINGS

These and further features and advantages of the present invention can be understood with reference to the drawings, in which.

DETAILED DESCRIPTION OF THE PREFERRED EMBODIMENT

Figure 1:
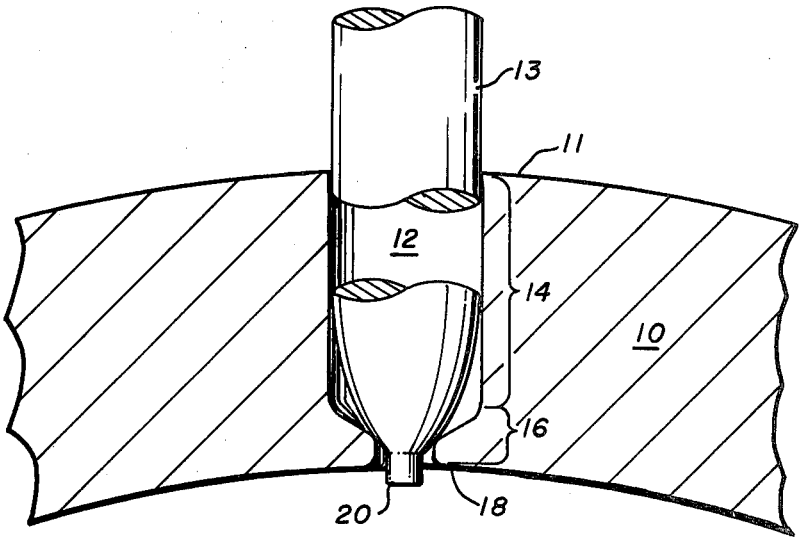
FIG. 1 is a cross-sectional view of a metal part having a hole drilled in it, a mandrel being shown in a side elevation positioned in the hole according to the teachings of the present invention.

Reference 10 refers to a fragment of the wall of a metal part, such as a header or drum. The metal part 10 is penetrated by a hole 12 that extends from a first surface 18 through the part to a second surface 11. A first portion 14 of the hole 12 extends from the second surface 11 partway through the hole 12. The diameter of the wider portion 14 is equal to the diameter that is desired for the hole that is to remain after the extrusion process. The second portion 16 of the hole has a smaller diameter and extends from the first surface 18 part of the way into the hole. The smaller-diameter portion 16 of the hole 12 is tapered to meet the desired-diameter portion 14.

A mandrel 13 is positioned in the hole 12, its leading end 20 having entered the hole 12 first. The mandrel has a diameter equal to the desired diameter over most of its length, but it is tapered toward the leading end to a diameter less than that of the smaller-diameter portion 16 of the hole 12.

The hole 12 can be formed by first drilling a small hole all the way through the part 10 and then drilling a larger hole only part of the way through. The percentage of the total width of the part 10 that is to be penetrated by the desired-diameter portion 14 of the hole 12 will depend on the specific application. It will depend, of course, on factors such as hole diameter, part thickness, and the material out of which the part is made. Recent experiments with carbon steel, part thicknesses of around five inches, and hole diameters of two inches have shown that depths of the desired-diameter portion 14 in the region of about 85 percent of the part thickness yield acceptable results.

The smaller-diameter portion 16 of the hole 12 is shown as being tapered to meet the desired-diameter portion 14. There is no reason in principle why a tapered section would be required, but it has been found that tapering, and in particular radiusing any resulting edges, helps to avoid tearing during the extrusion process. During experimentation, the different-diameter portions of the hole, the tapering, and the radiusing can be provided by successive drillings with different-sized bits, filing, and any other method known to the art. It is thought, however, that it would normally be desirable for production purposes to employ a single bit having a cross section that matches the shape of hole 12.

In preparation for the extrusion process, heat would normally be applied to surface 18 in the region of the hole 12. Any conventional means could be used for the application of heat, and a typical method would employ a ring burner of the appropriate size fired with gas. For some materials it may be found that the application of heat is not necessary, and in those cases the application of heat can be dispensed with, but it will be found that heat is required for most steel parts.

Figure 2:
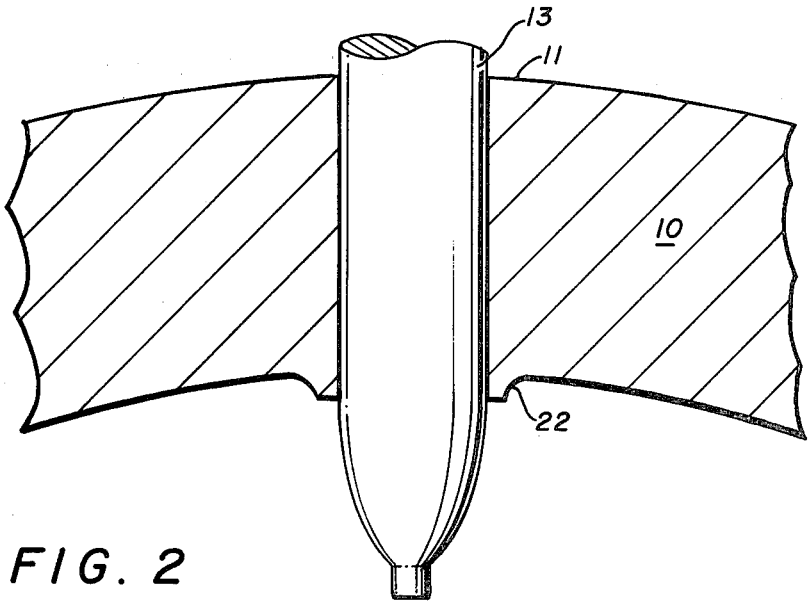
FIG. 2 is a cross-sectional view of the same part and mandrel after the mandrel has been forced through the part to form a nipple according to the teachings of the present invention.

Once the area has been heated the mandrel 13 is forced through the hole as shown in FIG. 2 to form a nipple 22.

In those applications in which the tube to be attached to the header is to be fitted through the hole, the outer diameter of the tube would equal the inner diameter of the nipple 22, and welding would take place between the tube and the interior of the nipple 22. If the tube to be attached is to terminate at the header, the inner diameter of the tube and the nipple 22 would be equal, and the tube would be butt welded to the nipple 22.

Though the invention has been described in the context of a specific embodiment, many variations and adaptations of the present invention will be apparent to those skilled in the art. Accordingly, it is meant to include all such adaptations and variations as fall within the spirit and broad scope of the appended claims.

What is claimed is:

1. A method of forming a hole in a metal part and extruding a nipple on a first surface of a metal part around the hole, the hole extending through the part from the first surface to a second surface on the part, and having a desired diameter, comprising the steps of:

a. forming an initial cylindrical hole in the part, the initial hole having the desired diameter along a first portion extending a major part of the way through the hole from the second surface, the hole having a smaller diameter along a minor second portion extending part of the way into the hole from the first surface; and b. forcing a mandrel through the initial hole from the second surface to the first surface, the mandrel having a diameter at its widest point equal to the desired diameter, thereby extruding material forming the smaller portion of the hole into a nipple on the first surface of the part.

2. The method as recited in claim 1, wherein both portions of the hole are formed by drilling.

3. The method as recited in claim 1, wherein the major portion of the hole extends approximately 85 percent of the way through the metal part, and the minor portion of the hole extends approximately 15 percent of the way through the metal part.

4. A method as recited in claim 1, wherein the small-diameter portion of the hole is tapered to meet the desired-diameter portion.

5. A method as recited in claim 4, wherein the leading end of the mandrel is tapered at least to the diameter of the smaller-diameter portion of the hole.

6. A method as recited in claim 5, wherein heat is applied to the first surface of the part around the hole before the mandrel is forced through the hole.

7. A method as recited in claim 4, wherein heat is applied around the hole to the first surface of the part before the mandrel is forced through the hole.

8. A method as recited in claim 1, wherein the leading end of the mandrel is tapered at least to the diameter of the small-diameter portion of the hole.

9. A method as recited in claim 8, wherein heat is applied to the first surface of the part around the hole before the mandrel is forced through the hole.

10. A method as recited in claim 1, wherein heat is applied to the first surface of the part around the hole before the mandrel is forced through the hole.

* * * * *